US007401699B1

(12) United States Patent
Griffin, Jr.

(10) Patent No.: US 7,401,699 B1
(45) Date of Patent: Jul. 22, 2008

(54) COMBINED TOOTHBRUSH AND TOOTHPASTE STORAGE DEVICE

(76) Inventor: Charles Edward Griffin, Jr., 2824 Thoreau St., Inglewood, CA (US) 90303

( * ) Notice: Subject to any disclaimer, the term of this patent is extended or adjusted under 35 U.S.C. 154(b) by 338 days.

(21) Appl. No.: 10/761,254

(22) Filed: Jan. 22, 2004

(51) Int. Cl.
*B65D 83/10* (2006.01)
*A45D 40/18* (2006.01)
*A47G 29/08* (2006.01)

(52) U.S. Cl. ..... 206/362.1; 132/314; 312/206

(58) Field of Classification Search ..... 206/362–362.1, 206/581; 132/314–315; 211/65–66, 87.01; 312/206–207, 117–123, 324–328
See application file for complete search history.

(56) References Cited

U.S. PATENT DOCUMENTS 1,409,701 A * 3/1922 Giles ..... 312/207
1,560,101 A * 11/1925 Ritter ..... 312/206
1,954,085 A * 4/1934 McMillan ..... 206/362.1
1,975,691 A * 10/1934 Hibbs ..... 211/65
2,576,560 A * 11/1951 Bidmon ..... 312/206
4,995,509 A * 2/1991 Kornfeind ..... 206/362.1
5,215,193 A * 6/1993 Dennis ..... 132/314
5,332,107 A * 7/1994 Williams ..... 206/362.1
6,220,253 B1 * 4/2001 Wright ..... 132/315
6,857,526 B2 * 2/2005 Vollmer ..... 211/65
6,877,619 B1 * 4/2005 Han ..... 211/65
2004/0055977 A1 * 3/2004 Ryan ..... 211/65

* cited by examiner

*Primary Examiner*—Bryon P. Gehman

(57) ABSTRACT

A device for storing upon a wall support surface a quantity of toothbrushes and tube of toothpaste. The storage device is comprised of a toothbrush container or receptacle having a plurality of individual cavities located at a front sidewall thereof, each cavity housing an individual, removable toothbrush storage receptacle; an internal cavity that houses a removable toothbrush carrying case located therein, the toothbrush carrying case storing a plurality of toothbrushes; a container located at the top side of the toothbrush container for storing a tube of toothpaste; and rear panel to affix the storage apparatus to the wall of a bathroom at a convenient location thereon.

13 Claims, 4 Drawing Sheets

COMBINED TOOTHBRUSH AND TOOTHPASTE STORAGE DEVICE

BACKGROUND OF THE INVENTION

This version of the invention is concerned with the field of toothbrush and toothpaste storage devices. More specifically, this version of the invention is concerned with toothbrush and toothpaste storage devices that are comprised of a main container or receptacle having a plurality of individual receptacles and compartments for hygienic storage of toothbrushes and toothpaste and attachment means to affix said storage container or receptacle to the wall of a bathroom at a convenient location therein.

PRIOR ART

Proper dental hygiene requires the regular use of a toothbrush and toothpaste to remove food particles and plaque from the exterior of teeth and to clean and massage the gums. In a dwelling, toothbrushes and toothpaste are typically stored in a bathroom or other room or space designated for personal hygiene. In most dwellings, especially those with families, the toothbrushes and toothpaste, contained in a tube, are stored in a variety of ways. A common means of toothbrush storage usually consists of a toothbrush rack or holder, which is comprised of a support member configured with several apertures into which toothbrushes are inserted and maintained thereon by the bristles thereof resting upon adjacent surfaces of the support bar. An attachment panel or means to affix the support member to a bathroom wall is located on a rear side of the support member in order to affix the toothbrush rack or holder to a wall surface at a convenient location thereon, typically over a sink or vanity where most tooth brushing occurs. Some toothbrush racks or holders are fabricated with means to store toothpaste, such as an aperture or depression for placement of a tube of toothpaste. Other means of storing toothbrushes may consist of unused drinking receptacles whereby one end of the toothbrush is placed into the interior of the cup and a second end is exposed above the cup edge or simply placing a toothbrush on the surface of a sink, vanity, or nearby shelf.

The means of storing toothbrushes described above are unsatisfactory in providing a sanitary and hygienic location to house toothbrushes during non-use. For instance, a toothbrush stored within a rack, holder, or cup whereby the bristles are exposed to the ambient environment may serve as a host for the accumulation of certain airborne organisms within the bristles thereof. The cup over time may accumulate dirt, dust, and other agents within the interior thereof, which may be transferred to the handle of a toothbrush and ultimately to the hands of the user and the bristles of the brush. Additionally, toothbrush positioned upon the surface of a sink or vanity may allow the bristles to collect dirt and or otherwise become soiled. Toothpaste that is not stored properly will soil adjacent areas as toothpaste will drop onto the surface of a sink or vanity or onto nearby toothbrushes.

What is needed then to overcome the aforementioned disadvantages of conventional methods and means of storing toothbrushes and toothpaste within a bathroom or other room or space wherein personal hygiene is performed is the provision of a toothbrush and toothpaste storage device that is comprised of a container or receptacle having a plurality of individual receptacles and compartments for hygienic storage of toothbrushes and toothpaste and attachment means to affix said storage container or receptacle to the wall of a bathroom at a convenient location therein. Such a storage device would allow storage of toothbrushes and toothpaste in various quantities therein and to permit attachment to the surfaces of walls.

DISCUSSION OF THE PRIOR ART

Numerous designs for toothbrush and toothpaste storage devices and apparatuses have been provided in the prior art. Even though these designs may be suitable for the specific individual purposes to which they address, they would not be suitable for the purposes of the present version of the invention as such storage devices and apparatuses are generally limited in their storage capacity and adaptability for attachment to various wall surfaces. For instance, U.S. Pat. No. 4,995,511, Toothbrush and Toothpaste Holder, issued to Evans on 26 Feb. 1991 discloses a toothbrush and toothpaste holder, a free standing container for storing toothbrushes and a quantity of toothpaste.

As such, it may be appreciated that there is a continuing need for a new and improved toothbrush and toothpaste storage device that is comprised of a container or housing into which a plurality of individual toothbrush receptacles are inserted and of a separate receptacle for storage of a tube of toothpaste. In a preferred embodiment of the invention, the storage device houses a toothbrush carrying case that can be removed from the storage device for transporting a plurality of toothbrushes in a hygienic environment. The toothbrush and toothpaste storage device can be affixed to wall surfaces proximate to a location at which tooth brushing occurs, such as that over a sink or vanity. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

The present version of the invention, which will be described in greater detail hereinafter, relates to the field of toothbrush and toothpaste storage devices. More specifically, this version of the invention is concerned with toothbrush and toothpaste storage devices that are comprised of a main container or receptacle having a plurality of individual receptacles and compartments for hygienic storage of toothbrushes and toothpaste and attachment means to affix said storage container or receptacle to the wall of a bathroom at a convenient location therein. My version of the invention overcomes all of the shortcomings listed previously, in addition to novel aspects that will be described in detail hereinafter.

Described briefly, according to a typical embodiment, the invention presents a toothbrush and toothpaste storage device that is comprised of a rectangular housing defined by a toothbrush container and a toothpaste tube container. A series of rectangular cavities are located in a front sidewall of the toothbrush container, and rectangular toothbrush receptacles with a sliding top panel are situated in the cavities. The toothpaste tube container is located on the top side of the toothbrush container and encloses a rectangular interior space into which a tube of toothpaste is stored. A cover is slidingly engaged within opposing sidewalls of the toothpaste tube container and can be opened to permit access to the interior of the toothpaste tube container and closed for storage of a tube of toothpaste.

A rectangular toothbrush carrying case is disposed within the interior of the toothbrush container through an aperture located on a sidewall of the container. A sliding panel permits access to the toothbrush carrying case, which can be removed from and inserted into the toothbrush container through said aperture. The toothbrush carrying case is comprised of a rectangular container into which a divider and foam pad is located. A sliding cover is disposed on opposing edges thereof into grooves formed into opposing sidewalls of the carrying case. A series of toothbrushes can be stored within individual compartments formed by the divider, the foam pad and sidewalls of the carrying case.

A concavity is located in the rear sidewall of the toothbrush container, and a VELCRO® pad is attached to an interior sidewall within said concavity. The concavity receives partially a wall housing base, which is comprised of a middle rigid panel, an adhesive layer attached a first side of the rigid panel, and a VELCRO® pad attached to a second side of the rigid panel. The wall housing base is affixed to a wall surface by means of the adhesive layer, and the toothbrush and toothpaste storage device is releasably attached to the wall housing base by engaging the VELCRO® pads.

My invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

OBJECTS OF THE INVENTION

Accordingly, it is an object of my version of the invention to provide a low-cost, easy-to-manufacture, and easy-to-market toothbrush and toothpaste storage device.

A further object of my version of the invention is to provide an easy-to-use and versatile toothbrush and toothpaste storage device.

A significant object of the invention is to provide a toothbrush and toothpaste storage device that is comprised of a rectangular housing having a toothbrush container, said container having a series of rectangular cavities located in a front sidewall thereof with rectangular toothbrush receptacles disposed in said cavities, an aperture located on a sidewall of said toothbrush container into which a toothbrush carrying case is housed, access to such permitted by a sliding panel door located over said aperture; a toothpaste tube container, said container located on the top side of the toothbrush container and enclosing a rectangular interior space into which a tube of toothpaste is stored, a cover located above said interior space and slidingly engaged within opposing sidewalls of the toothpaste tube container; and a wall housing base comprised of a middle rigid panel, adhesive layer attached to a first side of said panel, and a VELCRO® pad attached to a second side of said rigid panel, said VELCRO® pad releasably attached to a VELCRO® pad located within a concavity formed into a rear sidewall of said toothbrush and toothpaste storage device when said device is mounted to a wall surface, said method of mounting consisting of attaching the adhesive layer of the wall housing base to a wall surface and engaging said VELCRO® pads.

A final but very significant object of the invention is to provide a toothbrush and toothpaste storage device that permits a tube of toothpaste and a plurality of toothbrushes to be stored in a hygienic and sanitary manner within a bathroom or other room or space in which personal hygiene is performed and affixed to a wall surface in said rooms or spaces so as to allow easy access to said tube of toothpaste and toothbrushes proximate to an area at which tooth brushing is performed, such as over a sink or vanity.

Other objects and advantages of the present invention will become apparent from the following description, taken in connection with the accompanying drawings.

For a better understanding of the invention, its operating advantages and the specific objects attained by its uses, reference should be made to the accompanying drawings and descriptive matter in which there is illustrated the preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiments of the invention as illustrated in the accompanying drawings in which like reference characters refer to the same parts throughout different views. The drawings are not necessarily to scale, emphasis instead being placed upon illustrating the principles of the invention. The drawings constitute a part of this specification and include the exemplary embodiment to the invention, which may be embodied in various forms. It is to be understood that in some instances various aspects of the invention may be shown exaggerated or enlarged to facilitate an understanding of the invention.

DRAWING REFERENCE NUMERALS

10 Toothbrush and Toothpaste Storage Device
12 Toothbrush Container
14 Toothpaste Tube Container
16*a* Sidewall
16*b* Sidewall
18*a* Sidewall
18*b* Sidewall
20 Aperture
22 Toothbrush Receptacle
24 Receptacle Handle
26 Panel
28 Handle
30*a, b* Sidewall
32*a, b* Sidewall
34 Cover
36 Finger Pad
38 Wall Attachment Panel
40 Velcro Pad
42 Rigid Panel
44 Adhesive Layer
46 Cavity
48 Velcro Pad
50 Sidewall
52 Sidewall
54 Sidewall
56 Receptacle Cover
58 Cavity
60 Bottom Sidewall
62 Slot
64 Groove
66 Toothbrush Carrying Case
68 Container
70 Handle
72 Cover
74 Finger Pad
76 Knob
78*a, b* Sidewall
80*a, b* Sidewall
82 Slot
84 Groove
86 Foam Pad
88 Divider
90 Compartment
92 Toothbrush
94 Partition
96 Partition
98 Opening
100 Shank
102 Handle
104*a, b* Sidewall
106*a, b* Sidewall
108 Slot
110 Groove
112 Finger Pad
114 Finger Pad

DETAILED DESCRIPTION OF THE PREFERRED EMBODIMENT

A detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
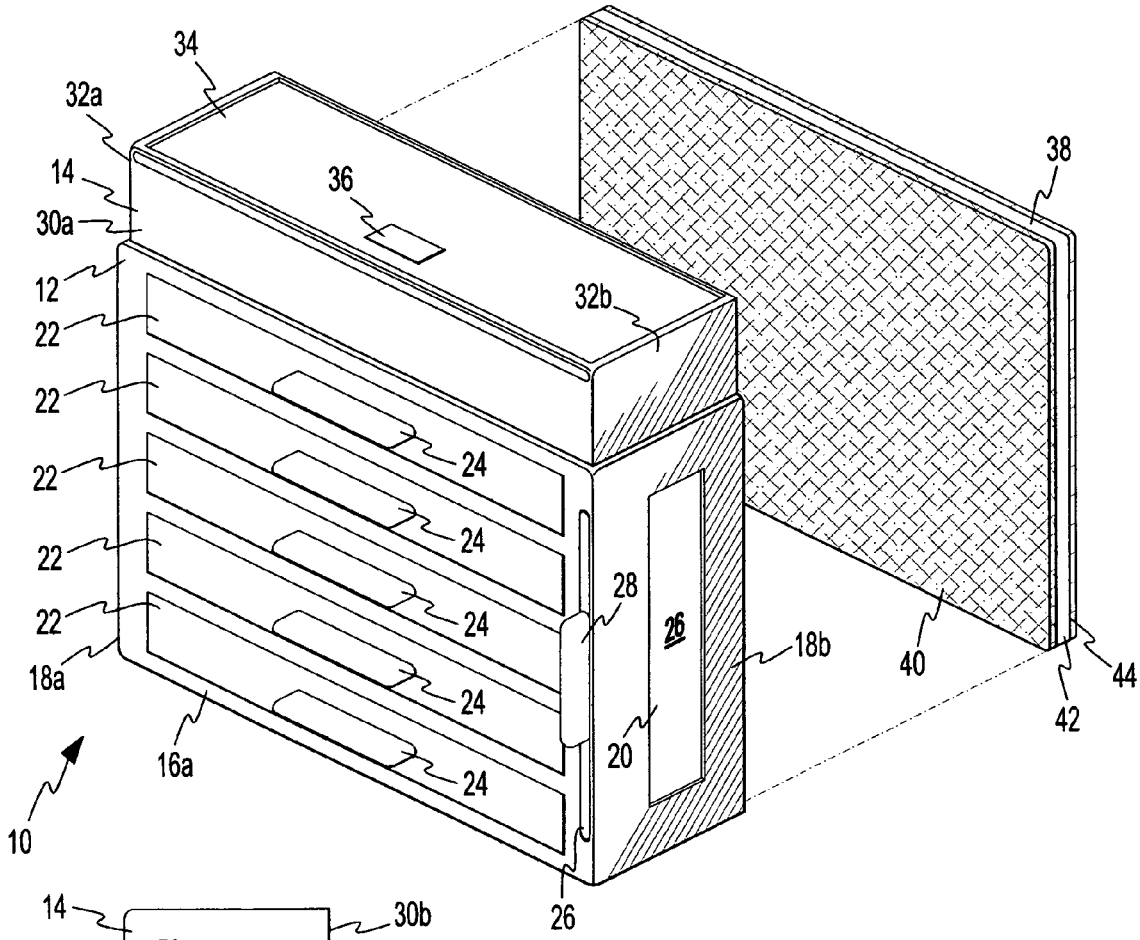
FIG. 1 is a perspective view of a toothbrush and toothpaste storage device in accordance with the present version of the invention with a wall attachment panel aligned for releasable attachment at a first side thereof to the rear of the toothbrush and toothpaste storage device and for attachment at a second side thereof to a wall.
Figure 2:
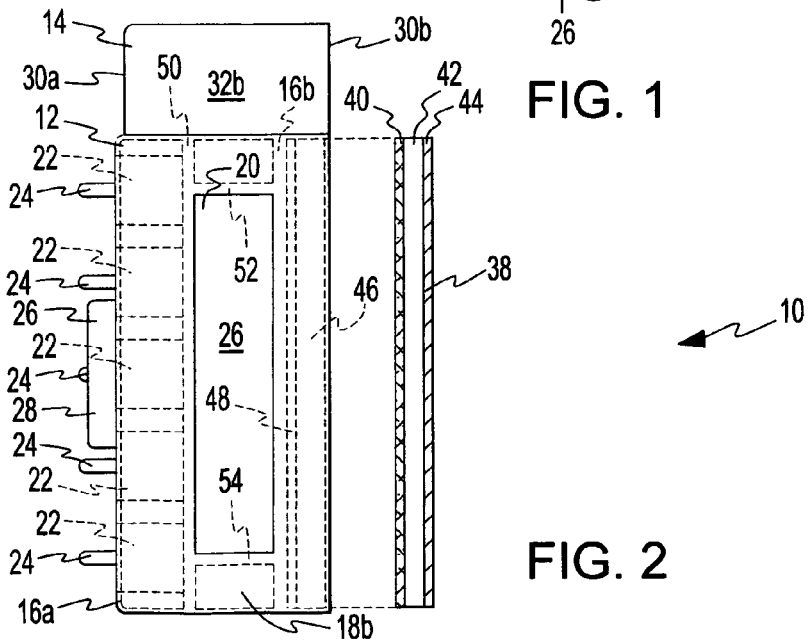
FIG. 2 is a side elevation view of a toothbrush and toothpaste storage device illustrating a rear cavity into which the wall attachment panel is inserted and attached to said device.

Referring now to the drawings and, in particular, to FIG. 1 wherein there is illustrated the toothbrush and toothpaste storage device 10. The present version of the invention 10 is comprised of a toothbrush container 12 and a toothpaste tube container 14, said toothpaste tube container 14 located on the top side of the toothbrush container 12. The toothbrush container 12 consists in part of opposed front 16*a* and rear 16*b* sidewalls (see FIG. 2 for rear sidewall 16*b* in phantom line) and opposed first 18*a* and second 18*b* lateral sidewalls. A rectangular aperture 20 is located in the second lateral sidewall 18*b*. A series of rectangular toothbrush receptacles 22 with handles 24 is disposed within cavities formed into the front sidewall 16*a* of the toothbrush container 12, and a rectangular panel 26 with handle 28 is disposed within a dedicated cavity located in said front sidewall 16*a* of the toothbrush container 12. The cavity receiving the panel 26 communicates with the aperture 20 at the second lateral sidewall 18*b* so that the panel 26, when inserted into said cavity, occupies the aperture 20.

The toothpaste tube container 14, located above the toothbrush container 12, is comprised in part of opposed front 30*a* and rear 30*b* sidewalls and opposed first 32*a* and second 32*b* lateral sidewalls. A rectangular cover 34 with finger pad 36 is disposed within the tube container 14 at the top edges thereof. A wall attachment panel 38 is aligned for attachment to within the rear side of the toothbrush container 12 of the storage device 10, said attachment panel 38 comprised of a rectangular pad 40 of hook and loop material, such as VELCRO®, rigid panel 42, and adhesive layer 44. As displayed in FIG. 2, a cavity 46 (shown in phantom line) is located within the rear side of the toothbrush container 12 of the storage device 10. A rectangular pad 48 (shown in phantom line) of hook and loop material, such as VELCRO®, is affixed to the rear sidewall 16*b* located adjacent to the cavity 46. As such, the storage device 10 is thus attached to a wall surface, such as that of a bathroom wall over a sink or vanity, by affixing the wall attachment panel 38 by means of the adhesive layer 44 to said wall surface and then positioning the rear side of the toothbrush container 12 of the storage device 10 against the wall attachment panel 38 until the wall attachment panel 38 is received by the cavity 46, and cooperating VELCRO® pads 40, 48 are engaged.

Referring again to FIG. 2, the aperture 20 and adjacent cavity are defined by the rear sidewall 16*b*, an opposed internal sidewall 50, top sidewall 52, and bottom sidewall 54 (all shown in phantom line).

The toothbrush and toothpaste storage device 10 and components thereof are comprised of material that is lightweight, durable, attractive, and resistant to transmission of moisture, such as plastic, hard rubber, various composite materials, and the like.

Figure 3:
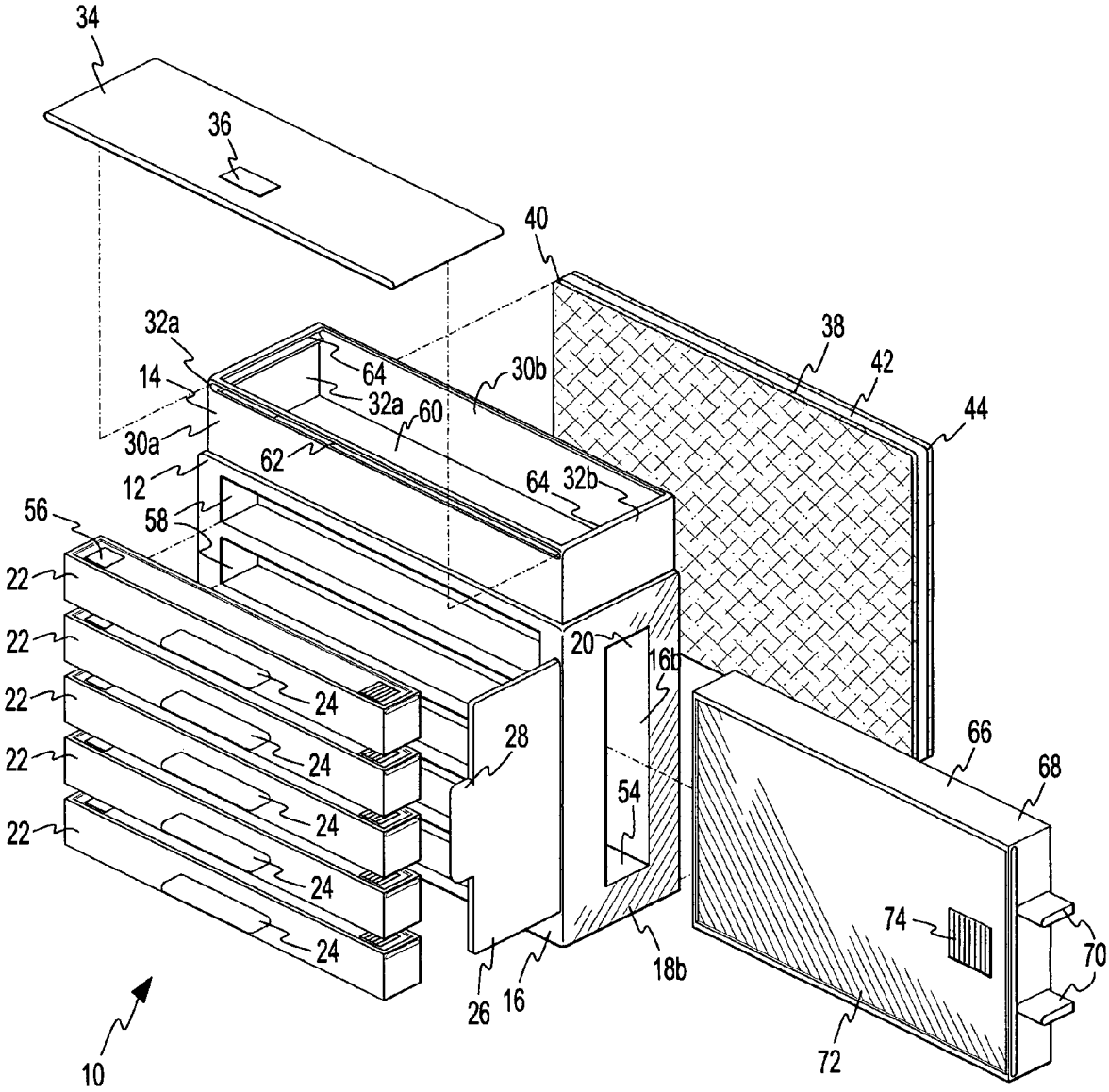
FIG. 3 is an exploded, perspective view of a toothbrush and toothpaste storage device in accordance with the present version of the invention illustrating the constituent components thereof.

Referring to FIG. 3, therein illustrated is the toothbrush and toothpaste storage device 10 illustrated in exploded, perspective view displaying the various storage receptacles and components thereof. A rectangular cover 56 panel is located at the top of each toothbrush receptacle 22. Each toothbrush receptacle 22 is disposed in a corresponding cavity 58 located within the toothbrush container 12. The interior space of the toothpaste tube container 14 is enclosed by opposed 30*a* and rear 30*b* sidewalls, opposed first 32*a* and second 32*b* lateral sidewalls, and a bottom sidewall 60 (i.e. the top sidewall of the toothbrush container 12.) The cover 14 is fitted into and through a slot 62 formed within the front sidewall 30*a* and maintained in place by grooves 64 formed into opposed lateral sidewalls 32*a, b*.

Figures 4, 5:
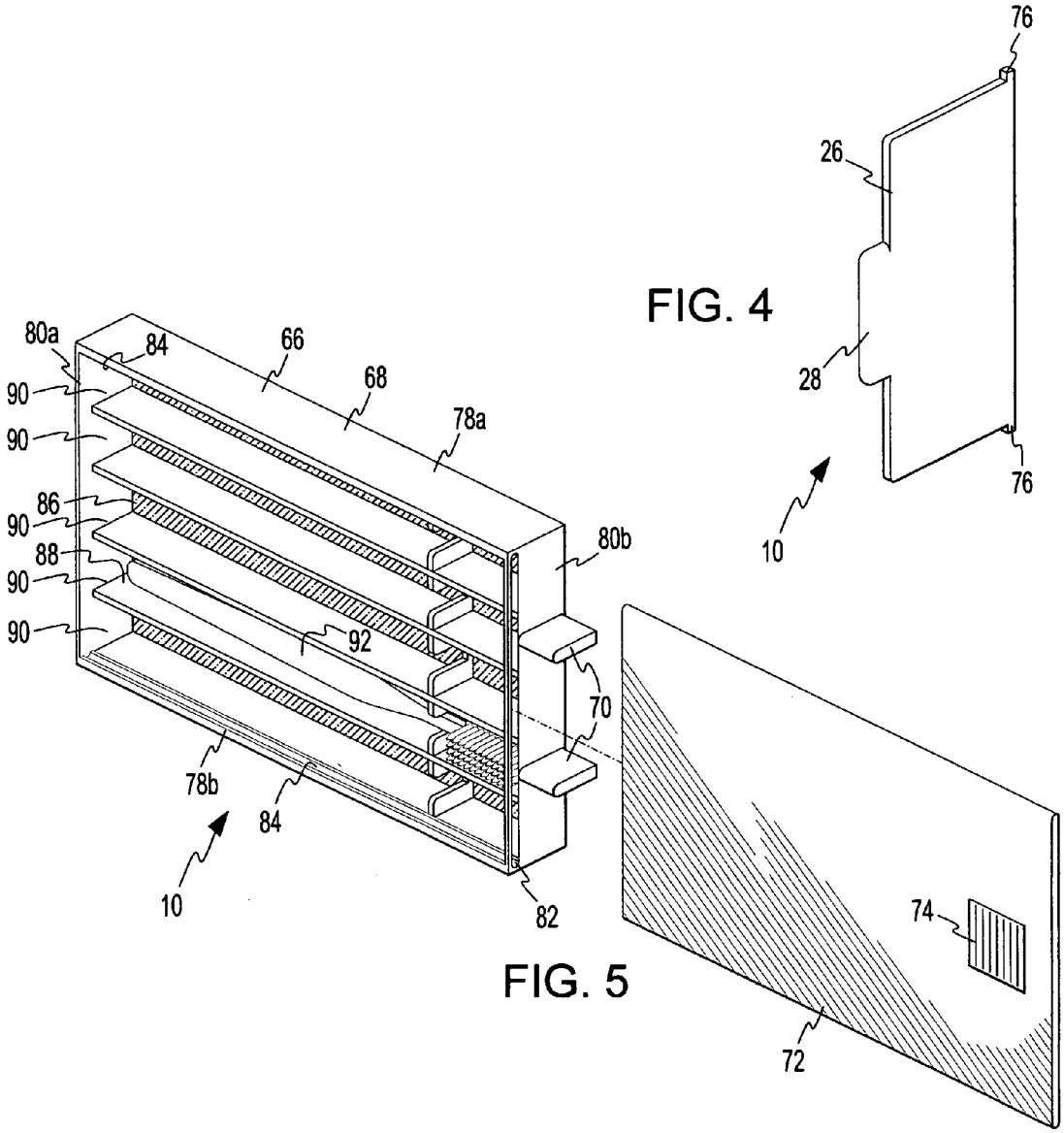
FIG. 4 is a detailed perspective view of a sliding panel of a toothbrush and toothpaste storage device.
FIG. 5 is a detailed perspective view of a toothbrush carrying case illustrating the constituent components thereof.

A toothbrush carrying case 66 is stored within the cavity located in the interior of the toothbrush container 12 and is accessed by sliding open the panel 26. The carrying case 66 is comprised of a rectangular container 68, two finger handles 70 extending from a sidewall thereof, and a cover 72 with finger pad 74. The case 66 can be removed from the container 12 via the aperture 20 in the sidewall 18*b* of said container 20 by grasping the finger handles 70. As shown in FIG. 4, a pair of knobs 76 is located on opposing corners of the panel 26 and functions to prevent the panel 26 from being separated from the container 12 when said panel 26 is pulled open to allow the carrying case 66 to be removed from or inserted into the toothbrush container 12.

The components of the carrying case 66 are illustrated in detail in FIG. 5. The toothbrush carrying case 66 is designed for carrying and storing a series of toothbrushes for transport, such as during travel away from home, or the like. The rectangular container 68 of the case 66 is comprised in part of a first sidewall 78*a* and a second 78*b* opposed sidewall and a third sidewall 80*a* and fourth 80*b* opposed sidewall. A slot 82 is located in the fourth sidewall 80*b* proximate to an unattached edge thereof, and grooves 84 are located in opposed sidewalls 78*a, b* proximate to unattached edges thereof. The cover 72 is releasably attached to the container 68 by being inserted through the slot 82 with opposed, longer side edges thereof disposed within the grooves 84 when said cover 72 is fully inserted into the container 68. A foam pad 86 is located within the container 68 adjacent to a rear or bottom sidewall of said container 68, and a divider 88 having a plurality of partitions is disposed within the interior of the container 68. The partitions of the divider 88 in conjunction with the foam pad 86 and sidewalls 78*a, b*, 80*a, b* of the container 68 form a plurality of compartments 90 suitable for storage of toothbrushes. As shown, a toothbrush 92 is stored within one of the compartments 90.

Figure 6:
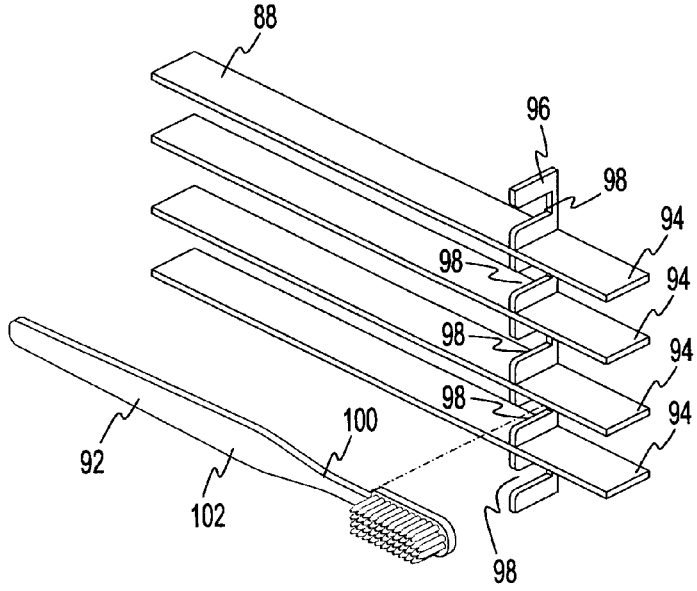
FIG. 6 is a detailed perspective view of the divider of a toothbrush carrying case illustrating the construction thereof.

The divider 88, illustrated in FIG. 6, is comprised of a series of elongate, rectangular partitions 94 that are disposed in parallel relation to each other. The partitions 94 are connected in perpendicular arrangement proximate to one end thereof to a single partition 96. Openings 98 are located in the single partition 96 adjacent to connections with elongate rectangular partitions 94. The openings 98 receive the shank portion 100 of a toothbrush handle 102 when said toothbrush 92 is inserted within one of the compartments 90, said compartments 90 formed when the divider 88 is disposed within the container 68 of the toothbrush carrying case 66. More particularly, the compartments 90 are defined by any two adjacent elongate rectangular partitions 94, the foam pad 86, and lateral sidewalls 80*a, b* of the container 68 of the toothbrush carrying case 66, or an elongate rectangular partition 94, the foam pad 86, and adjacent sidewalls 78*a, b*, 80*a, b* of the container 68 of the toothbrush carrying case 66.

Figure 7:
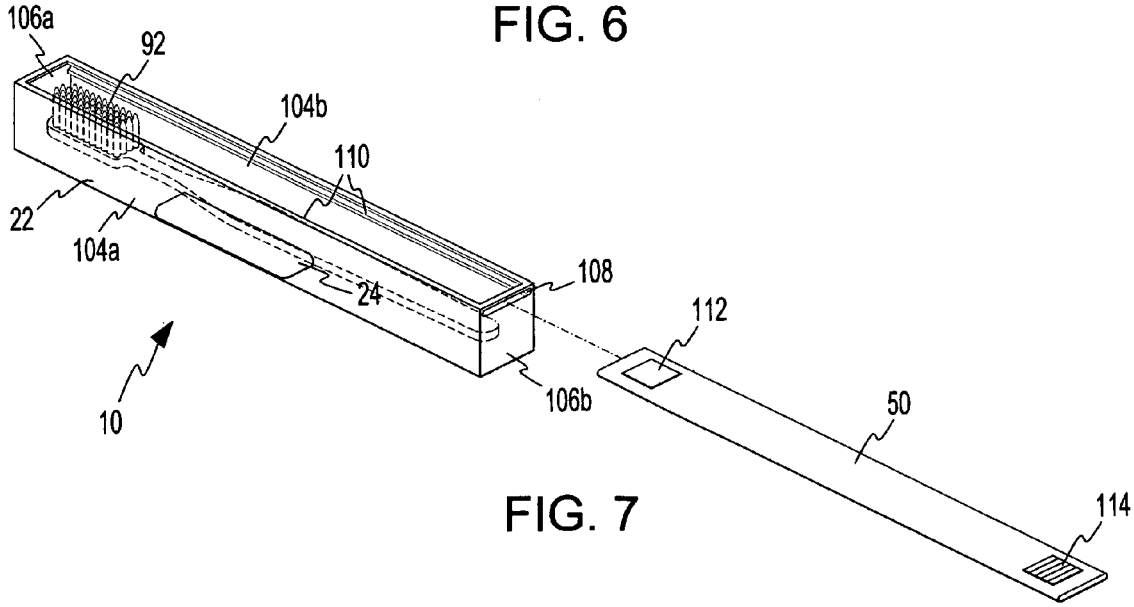
FIG. 7 is a detailed perspective view of a toothbrush receptacle illustrating the constituent components thereof.

In FIG. 7, a toothbrush receptacle 22 is therein illustrated in detail. The receptacle 22 is comprised in part of a first pair of opposed first 104*a* and second 104*b* sidewalls and a second pair of opposed first 106*a* and second 106*b* sidewalls. A slot 108 is located in a sidewall 106*b* proximate to an unattached edge thereof, and grooves 110 are located in opposed sidewalls 104*a, b* proximate to unattached edges thereof. The cover 50 with finger pads 112, 114 is releasably attached to the receptacle 22 by being inserted into and through the slot 108 with opposing, longer side edges of said cover 50 disposed within cooperating grooves 110 when said cover 50 is fully inserted into the receptacle 22. A toothbrush 92 is located within the interior of the receptacle 22.

While this version of the invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. For instance, the toothbrush and toothpaste storage device can contain a toothbrush sterilizer with lights signaling the end of sterilization, toothpaste warmer, toothpaste and mouthwash dispenser, cup holder, and other features, such as integrated television, radio, time clock, and the like.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved toothbrush and toothpaste storage device has been provided. The invention is relatively simple and easy to manufacture, yet affords a variety of uses. While my description contains many specificities, these should not be construed as limitations on the scope of the version of the invention, but rather as an exemplification of the preferred embodiment thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

While the invention has been described in connection with the preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A combined toothbrush and toothpaste storage device comprising:

(a) a toothbrush container, wherein said container is comprised of a front sidewall and an opposed rear sidewall, a first lateral sidewall and a second, opposed lateral sidewall, and having a series of elongate rectangular cavities located at said front sidewall thereof with removable rectangular toothbrush receptacles disposed in said cavities, a sliding panel with a grasping handle, said sliding panel disposed within an elongate aperture located at said front sidewall between said toothbrush receptacles and said second lateral sidewall, and an aperture located at said second lateral sidewall of said toothbrush container and communicating with a cavity of said toothbrush container, said cavity housing a removable toothbrush carrying case;

(b) a toothpaste tube container located on the top side of said toothbrush container, said toothpaste tube container having a front sidewall and an opposed rear sidewall; a first lateral sidewall and an opposed second lateral sidewall; and a bottom sidewall, said sidewalls defining an interior space into which a tube of toothpaste is stored, a detachable cover disposed within a slot located in said front sidewall and slidingly engaged within grooves of said first and second lateral sidewalls so as to be located above said interior space; and (c) attachment means to affix said storage device to a supporting wall surface, said attachment means attached to a rear sidewall of said toothbrush container and located within a cavity at the rear side of said toothbrush container.

2. The combined toothbrush and toothpaste storage device as recited in claim 1, wherein said sliding panel has said grasping handle located at a first side thereof and a pair of interiorly located knobs extending from opposed corners located at a second side thereof, said knobs engaging the interior side of said front sidewall when said sliding panel is fully extended from said front sidewall.

3. The combined toothbrush and toothpaste storage device as recited in claim 1, wherein said sliding panel can be maintained in either a closed position or an opened position, said closed position comprised of said sliding panel retracted within the interior of said toothbrush container leaving said grasping handle exposed and covering said aperture located at said second lateral sidewall of said toothbrush container in order to hold said removable toothbrush carrying case inside said cavity of said toothbrush container, or said opened position comprised of said sliding panel extended from said front sidewall of said toothbrush container to uncover said aperture located at said second lateral sidewall of said toothbrush container in order to allow access to said removable toothbrush carrying case located inside said cavity of said toothbrush container.

4. The combined toothbrush and toothpaste storage device as recited in claim 1, wherein said cavity that houses said removable toothbrush carrying case is defined by said rear sidewall of said toothbrush container, an opposed internal sidewall, a top sidewall, and a bottom sidewall.

5. The combined toothbrush and toothpaste storage device as recited in claim 1, wherein each rectangular toothbrush receptacle is comprised of a bottom sidewall; a front, longer sidewall and an opposed rear, longer sidewall, a grasping handle located medially on said front sidewall; and a first, shorter lateral sidewall and a second, shorter lateral sidewall, said sidewalls enclosing an interior space into which a toothbrush is stored; and a detachable receptacle cover slidingly engaged to said opposed front and rear longer sidewalls.

6. The combined toothbrush and toothpaste storage device as recited in claim 5, wherein opposed front and rear longer sidewalls of each toothbrush receptacle each have one groove located adjacent to each top edge thereof; and a second, shorter lateral sidewall has an elongate opening located adjacent to the top edge thereof, said opening aligned with said two grooves so that said detachable receptacle cover is disposed through said elongate opening of said second lateral sidewall, and opposed longer side edges of said receptacle cover are received in sliding engagement by said two grooves of said front and rear sidewalls of said toothbrush receptacle.

7. The combined toothbrush and toothpaste storage device as recited in claim 1, wherein said removable toothbrush carrying case is comprised of a rectangular housing having a first sidewall, and a second, opposed sidewall, a third sidewall and a fourth, opposed sidewall, a pair of grasping handles extending outwardly from said fourth sidewall, and a bottom sidewall, said sidewalls enclosing an interior space; a divider located within said interior space of said housing and having partitions that in conjunction with said sidewalls of said housing delineates a series of compartments for storing individual toothbrushes; and a detachable cover slidingly engaged at top edges of said first and second opposed sidewalls.

8. The combined toothbrush and toothpaste storage device as recited in claim 7, wherein said divider is comprised of a series of elongate, rectangular partitions disposed in parallel arrangement, said partitions separated from each other by a distance adequate to receive a toothbrush, and a single partition connected in perpendicular arrangement to said elongate, rectangular partitions proximate to one end thereof, said single partition having a rectangular opening located therein between any two elongate, rectangular partitions or adjacent to any elongate, rectangular partition.

9. The combined toothbrush and toothpaste storage device as recited in claim 8, wherein said single partition maintains in frictional engagement a toothbrush within each rectangular opening thereof.

10. The combined toothbrush and toothpaste storage device as recited in claim 7, wherein said first and second opposed sidewalls of the removable toothbrush carrying case each have one groove located adjacent to each top edge thereof, and said fourth sidewall has an elongate opening located adjacent to the top edge thereof, said opening and said two grooves disposed in coalignment and able to receive said detachable cover in sliding engagement within said opening and said two grooves.

11. The combined toothbrush and toothpaste storage device as recited in claim 1, wherein said attachment means is comprised of a wall attachment panel that is securely attached at a first side thereof to a supporting wall surface and releasably attached at a second side thereof to a cooperating panel located adjacent to said rear sidewall of said toothbrush container.

12. The combined toothbrush and toothpaste storage device as recited in claim 11, wherein said wall attachment panel is comprised of a layer of hook and loop material a middle rigid panel, and a layer of adhesive material, said layer of hook and loop material attached to a first side of said middle rigid panel and said layer of adhesive material attached to an opposed second side of said middle rigid panel.

13. The combined toothbrush and toothpaste storage device as recited in claim 11, wherein said cooperating panel located adjacent to said rear sidewall of said toothbrush container is comprised of hook and loop material.

* * * * *